US011529818B2

(12) United States Patent
Anderson

(10) Patent No.: US 11,529,818 B2
(45) Date of Patent: Dec. 20, 2022

(54) CO-AXIAL SPLIT DRIVE ROLLERS

(71) Applicant: Hewlett-Packard Development Company, L.P., Spring, TX (US)

(72) Inventor: Ronald R. Anderson, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/267,077

(22) PCT Filed: Nov. 16, 2018

(86) PCT No.: PCT/US2018/061475
§ 371 (c)(1),
(2) Date: Feb. 9, 2021

(87) PCT Pub. No.: WO2020/101699
PCT Pub. Date: May 22, 2020

(65) Prior Publication Data

US 2021/0309027 A1 Oct. 7, 2021

(51) Int. Cl.

| | |
|---|---|
| ***B41J 15/04*** | (2006.01) |
| ***B41J 3/60*** | (2006.01) |
| ***B65H 27/00*** | (2006.01) |
| ***B65H 23/025*** | (2006.01) |
| ***B41J 15/22*** | (2006.01) |

(52) U.S. Cl.
CPC ..... *B41J 15/04* (2013.01); *B41J 3/60* (2013.01); *B41J 15/22* (2013.01); *B65H 23/0251* (2013.01); *B65H 27/00* (2013.01); *B65H 2404/132* (2013.01); *B65H 2404/1321* (2013.01); *B65H 2404/13211* (2013.01); *B65H 2404/13212* (2013.01)

(58) Field of Classification Search
CPC ... B41J 15/04; B41J 3/60; B41J 15/22; B65H 23/0251; B65H 27/00; B65H 2404/132; B65H 2404/1321; B65H 2404/13211; B65H 2404/13212
See application file for complete search history.

(56) References Cited

U.S. PATENT DOCUMENTS

| | | | |
|---|---|---|---|
| 2,817,940 | A | 12/1957 | Lorig |
| 3,265,271 | A | 8/1966 | Eugene et al. |
| 4,395,152 | A | 7/1983 | Hendrischk |
| 4,403,878 | A | 9/1983 | Hosogaya |
| 4,485,836 | A | 12/1984 | Streubel et al. |
| 4,857,942 | A | 8/1989 | Murphy et al. |
| 5,322,273 | A | 6/1994 | Rapkin et al. |
| 5,323,945 | A | 6/1994 | Matoushek |

(Continued)

FOREIGN PATENT DOCUMENTS

WO WO-1994002320 A1 2/1994

*Primary Examiner* — Henok D Legesse

(57) ABSTRACT

In example implementations, a printer module is provided. The printer module includes a co-axial split drive roller, a first motor, a second motor, and a print bar. The co-axial split drive roller includes a first roller and a second roller that are movably coupled at a center of the co-axial split drive roller. The first motor is coupled to the first roller. The second motor is coupled to the second roller. The print bar is coupled to the housing over the co-axial split drive roller.

9 Claims, 5 Drawing Sheets

(56) References Cited

U.S. PATENT DOCUMENTS

| | | | | |
|---|---|---|---|---|
| 6,042,228 | A * | 3/2000 | Yamada | B41J 2/01 347/104 |
| 2009/0165985 | A1 | 7/2009 | Bekurts et al. | |
| 2014/0043390 | A1* | 2/2014 | Maeda | B41J 11/30 226/76 |
| 2018/0236795 | A1* | 8/2018 | Takahashi | B41J 15/16 |

* cited by examiner

202

402

CO-AXIAL SPLIT DRIVE ROLLERS

BACKGROUND

Print devices can be used to print images or text onto print media. Print devices can come in a variety of different forms and use different types of print material. For example, some print devices may be a multi-function device that can provide different functions include fax, copy, print, and the like. Some print devices may use jetted ink, toner cartridges, and the like.

Some print devices may be capable of printing on both sides of a print media. For example, the printer may have a paper path that flips the print media. The print device may then print an image or ink on the opposite side of the print media.

DETAILED DESCRIPTION

Examples described herein provide a co-axial split drive roller that can be deployed in print modules that have side-by-side printing. As noted above, some printers may print on both sides of the print media. Printers may include any type of printing device or multi-function device that can dispense print material (e.g., ink, toner, and the like) onto a print media. For example, the printers may process print jobs, copy, fax, scan, and the like. Some print devices may have a print module that has a set of print bars that can print on two sides of a continuous web of print media simultaneously.

For example, a first side of the print media may be printed by one side of the print bars and a second side of the print media may be printed by a second side of the print bars at the same time. In some designs, multiple rollers may be used to transport the print media for printing on the different sides of the print media. For example, one set of rollers may transport the print media for printing on a first side and a different set of rollers may transport the print media for printing on a second side.

However, the costs of the rollers may be relatively high. As a result, using a different set of rollers for transporting the print media for front side printing and back side printing can add to the overall costs to build the print module.

In some instances, it may be useful to allow the speed of the print media on the different sides of the print bars to be different. Current drive rollers are a single piece roller that are driven by a single motor. Thus, the rotational speed of the roller may be constant across the entire length of the drive roller.

The present disclosure provides a co-axial split drive roller. The drive roller may comprise two different ends that are movably coupled together. Each end of the driver roller may be coupled to a respective motor. As a result, each end of the driver roller may be driven at a rotational speed that is independent from the other end.

Figure 1:
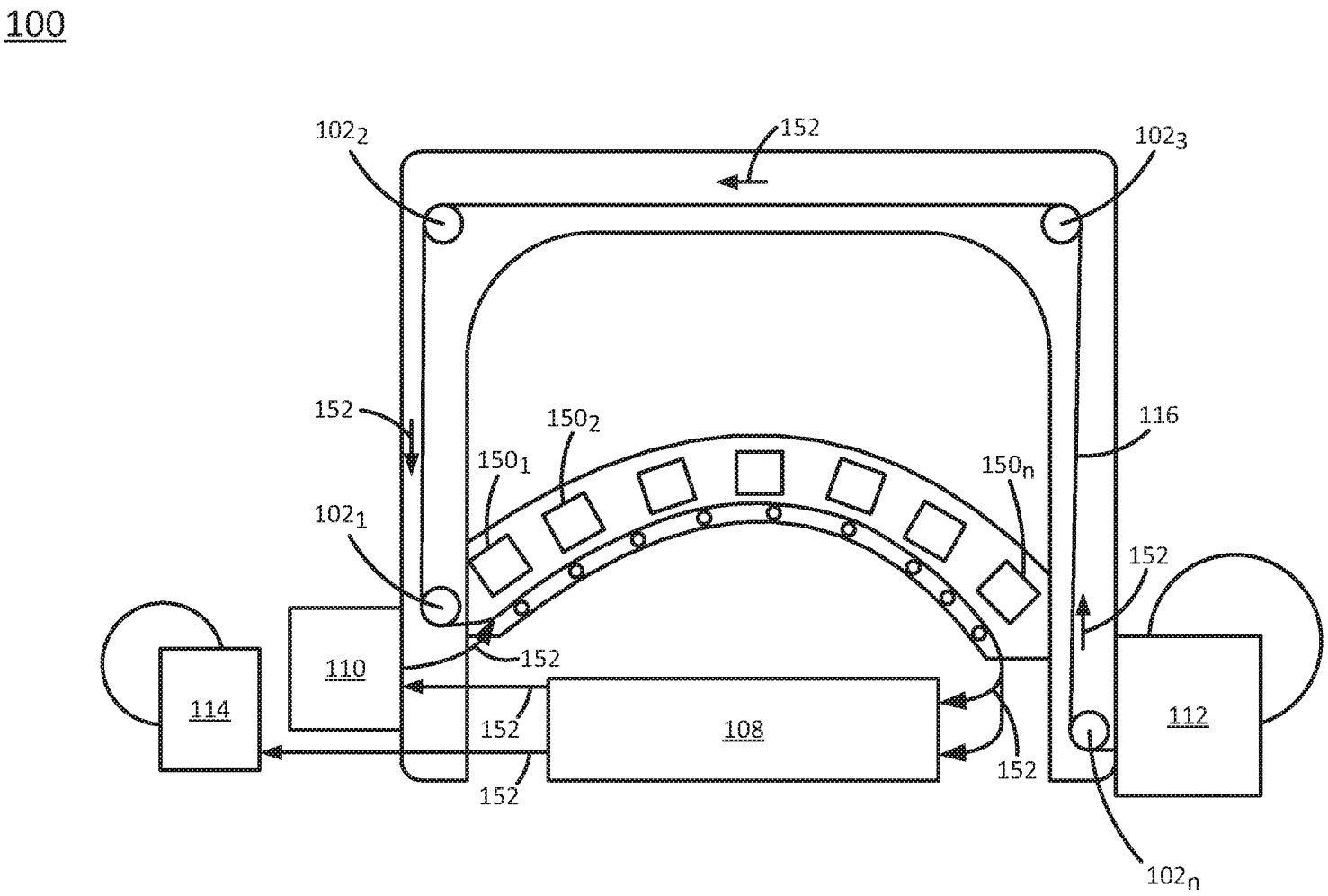
FIG. 1 is a block diagram of an example printing device of the present disclosure.

FIG. 1 illustrates an example a printing device 100 of the present disclosure. The printing device 100 may be part of a larger print apparatus and may include other modules and components that are not shown. For example, the print device 100 may be for printing on a continuous web of print media and may include a feed 112 to provide a continuous web of print media 116, a collector 114 to collect the print media 116 after a print job on the print media 116 is completed, a dryer module 108 to dry print material that is dispensed on the print media 116, a turnbar module 110 to flip the print media 116 to process a second side of the print media 116 through the print device 100, a controller to control operation of the printing device 100 and other components, and the like. In one example, the components of the print device 100 may be arranged to feed the print media 116 in a direction as shown by arrows 152 in FIG. 1.

In one example, the printing device 100 may include at least one co-axial split drive roller 102. In one example, the printing device 100 may include a plurality of co-axial split driver rollers $\mathbf{102}_1$ to $\mathbf{102}_n$ (hereinafter also referred to collectively as rollers 102). In one example, the rollers 102 may be located at positions in the paper path that are between processes. For example, one roller 102 may be positioned after printing before a print media 116 is sent to a dryer module 108 and another roller 102 may be placed before printing begins. However, it should be noted that the arrangement of the rollers 102 illustrated in FIG. 1 is one example.

As discussed in further details below, each one of the co-axial split driver rollers 102 may include a first roller and a second roller. The first roller and the second roller may be coupled at a center of the co-axial split driver roller 102. The first roller and the second roller may be coupled in different ways as illustrated in FIGS. 2-5 and discussed in further details below.

The first roller may be driven by a first motor that is coupled to a first end of the first roller. The second roller may be driven by a second motor coupled to a first end of the second roller. Examples are illustrated in FIGS. 2-5 and discussed in further details below. The design of the co-axial split drive rollers 102 may allow the first roller and the second roller to be driven independently of each other via the respective motors. The first motor and the second motor may drive the first roller and the second roller, respectively, in a rotational direction.

In one example, the first roller and the second roller may be fabricated from a metal, metal alloy, and the like. The size or diameter of the first roller and the second roller may be a function of a desired maximum loading. For example, the larger the desired maximum load, the larger the diameter of the first roller and the second roller. In addition, the maximum rotational speed of the first roller and the second roller may be a function of a horsepower of the first motor and the second motor and a diameter of the first roller and the second roller.

In other words, a portion of the print media 116 may be driven at a first speed along a transport direction by the first rollers of the rollers 102. A different portion of the print media 116 may be driven at a second speed along a transport direction by the second rollers of the rollers 102. The transport direction of the first roller and the second roller may be the same or may be opposite directions. The rotational speed of the first roller and the rotational speed of the second roller may be the same speed or different speeds. In other words, the design of the co-axial split drive roller 102 may allow different portions of the print media 116 to be transported side-by-side or adjacent to one another at independently controlled speeds.

In addition, as discussed in further details below, the design of the co-axial split drive roller 102 minimizes the amount of hardware and space used to connect the first roller to the second roller. As a result, a distance between the inner edges of different portions of the print media 116 may be minimized on the co-axial split driver roller 102. This may allow the overall design of the printing device 100 to be minimized and reduce the costs associated with building the printing device 100.

In one example, the printing device 100 may also include at least one print bar 150. In one example, the printing device 100 may include a plurality of print bars $\mathbf{150}_1$ to $\mathbf{150}_n$ (hereinafter also referred to collectively as print bars 150). The print bars 150 may include two sets of print heads on each end of the print bars 150. One set of print heads may print on a first side of the print media 116 that travels over the first roller. A second set of print heads may print on a second side (that is opposite the first side) of the print media 116 that travels over the second roller.

The print bars 150 may be coupled to an assembly (not shown) that allows the print bars 150 to be moved away from the rollers 102. In one example, the driver rollers 102 and the print bars 150 may be coupled to a support structure, a base, or a housing that encloses the print device 100. In other words, FIG. 1 illustrates an internal view of the printing device 100.

In one example, the printing device 100 may be used to simultaneously print on two sides of a print media. For example, the print media 116 may have a first side driven by the first roller. The first set of print heads of the print bars 150 may print, or dispense print material, on the first side of the print media 116 driven by the first roller. The print material may be any type of material to print text or an image on the print media 116. For example, the print material may be a jetted ink, toner, and the like.

The print media 116 may have a second side of the same print media 116 from a continuous web of print media 116. The second set of print heads on the print bars 150 may print, or dispense print material, on the second side of the print media 116 driven by the second roller.

It should also be noted that FIG. 1 has been simplified for ease of explanation. The printing device 100 may include other rollers, nips, paper paths, and the like, to transport the print media 116 that are not shown.

Figure 2:
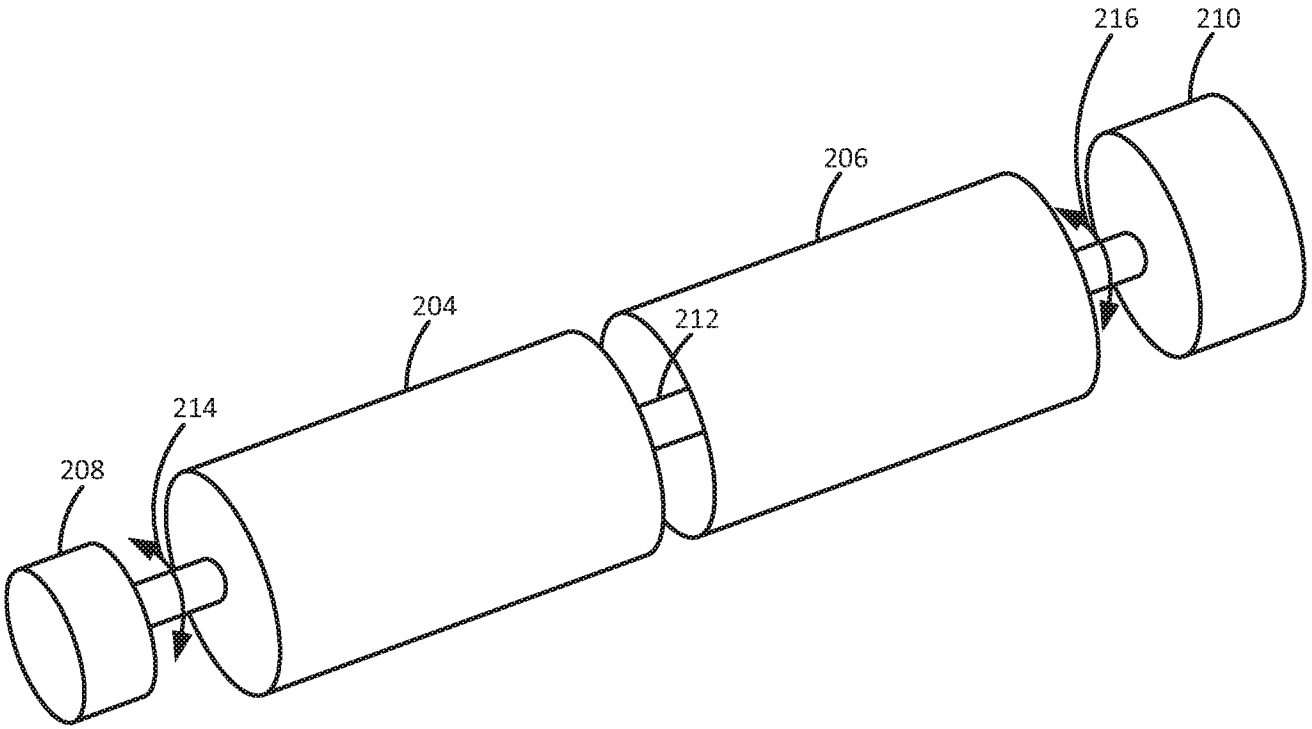
FIG. 2 is an illustration of a first example of a co-axial split drive roller of the present disclosure.

FIG. 2 illustrates an example of a co-axial split drive roller 202 (also herein referred to as a roller 202). In one example, the roller 202 may include a first roller 204 and a second roller 206. The first roller 204 may be driven by a first motor 208 that drives the first roller 204 along a rotational direction shown by an arrow 214. The second roller 206 may be driven by a second motor 210 that drives the second roller 206 along a rotational direction shown by an arrow 216.

As noted above, the first motor 208 and the second motor 210 may drive the first roller 204 and the second roller 206 in the same direction or in different, opposite directions. The first motor and the second motor 210 may drive the first roller 204 and the second roller 206 at the same rotational speed or at different rotational speeds. Thus, the first roller 204 and the second roller 206 may be controlled at different operational speeds or directions for a particular application.

In one example, the first roller 204 and the second roller 206 may be coupled to a central dead shaft 212. The first roller 204 and the second roller 206 may rotate independently around the central dead shaft 212. The central dead shaft 212 may be fixed so that the central dead shaft 212 does not rotate. As a result, the first roller 204 and the second roller 206 may be coupled to the central dead shaft 212 to minimize a distance between two adjacent sheets of print media that travel over the first roller 204 and the second roller 206.

In one example, the first roller 204 and the second roller 206 may have a textured coating. The textured coating may provide a better grip with the print media 116 while rotating to transport the print media 116.

Figure 3:
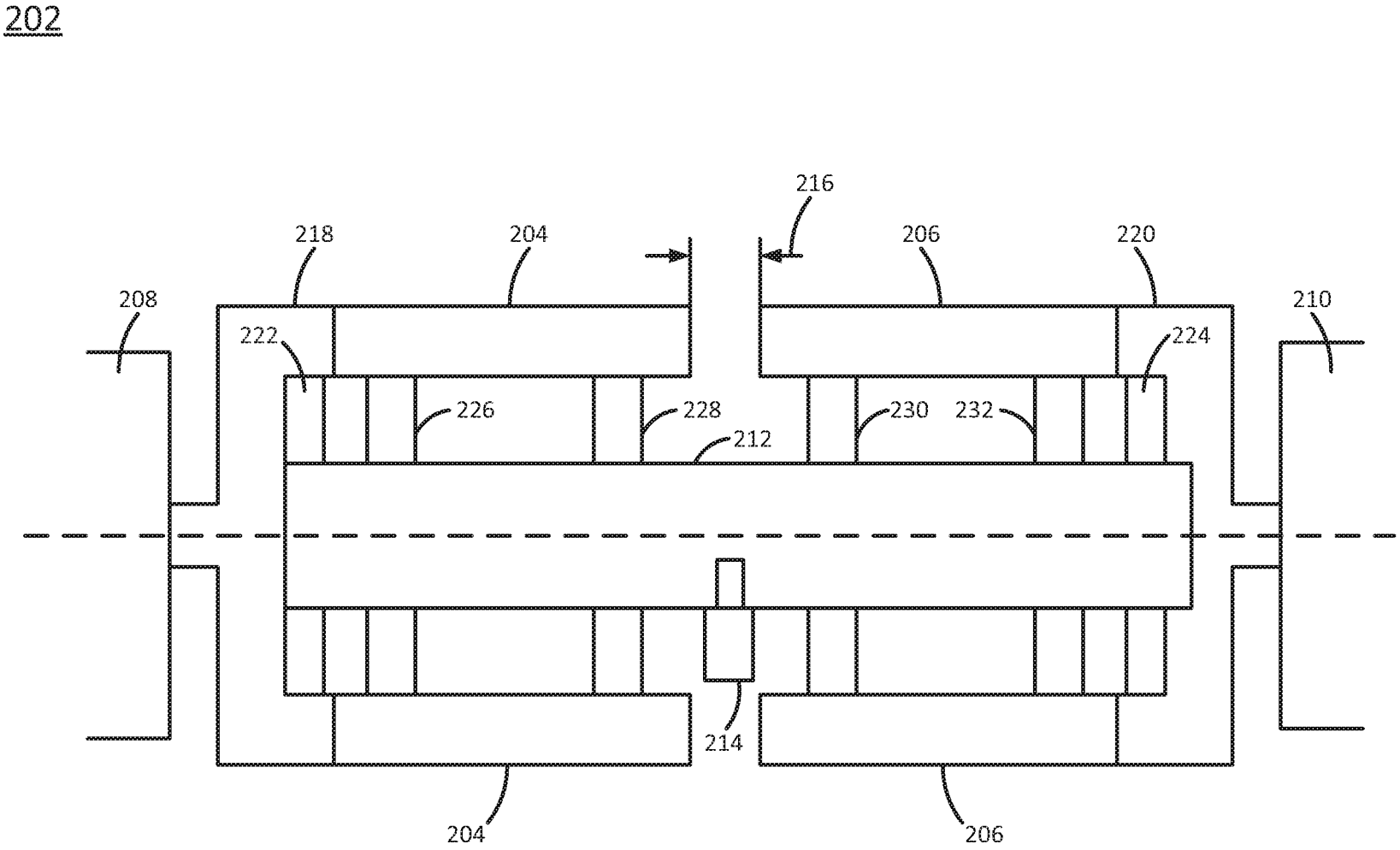
FIG. 3 is a cross-sectional view of the first example of the first co-axial split drive roller of the present disclosure.

FIG. 3 illustrates a cross-sectional view of the co-axial split drive roller 202 illustrated in FIG. 2. In one example, the first roller 204 and the second roller 206 may be formed as hollow cylinders. A pair of bearings 226 and 228 may be inserted into the first roller 204. A pair of bearings 230 and 232 may be inserted into the second roller 206. The bearings 226, 228, 230, and 232 may be a ring shape. The central dead shaft 212 may be fit or inserted through the bearings 226, 228, 230, and 232. As a result, the first roller 204 may rotate independently around the central dead shaft 212 via the bearings 226 and 228. The second roller 206 may rotate independently around the central dead shaft 212 via the bearings 230 and 232.

In one example, a first header 218 may be coupled to a first header bearing 222 also having a ring shape. The first header 218 may be an end cap. A first end of the central dead shaft 212 may be inserted through the center of the first header bearing 222. The first header 218 may be coupled to an end of the first roller 204. The first header 218 may then be coupled to the first motor 208. As a result, the first motor 208 may rotate the first header 218, which may then rotate the first roller 204.

Similarly, a second header 220 may be coupled to a second header bearing 222 also having a ring shape. A second end of the central dead shaft 212 may be inserted through the center of the second header bearing 224. The second header 220 may be coupled to an end of the second roller 206. The second header 220 may then be coupled to the second motor 210. As a result, the second motor 210 may rotate the second header 220, which may then rotate the second roller 206.

In one example, the bearings 226, 228, 230, and 232, the first header bearing 220, and the second header bearing 224 may be ball-plunger type bearings with inner race constraints. The ball-plunger type bearings with inner race constraints may allow for thermal expansion as heat is generated by friction/movement of the first roller 204, the second roller 206, the first header 218, and the second header 220.

In one example, the co-axial split driver roller 202 may include a fastener 214. The fastener 214 may be a mechanical fastener that provides a center web support to prevent excessive deflection. The fastener 214 may be located at a center point of the central dead shaft 212. The fastener 214 may help locate the center of the central dead shaft 212 during installation. The fastener 214 may be a dowel pin.

In one example, a distance 216 between the first roller 204 and the second roller 206 may be a function of a width of the fastener 214. In one example, the distance 216 may be approximately less than 1 inch. In one example, the distance 216 may be approximately 0.3 inches to 0.6 inches. In one example, the distance 216 may be approximately 0.4 inches.

Figure 4:
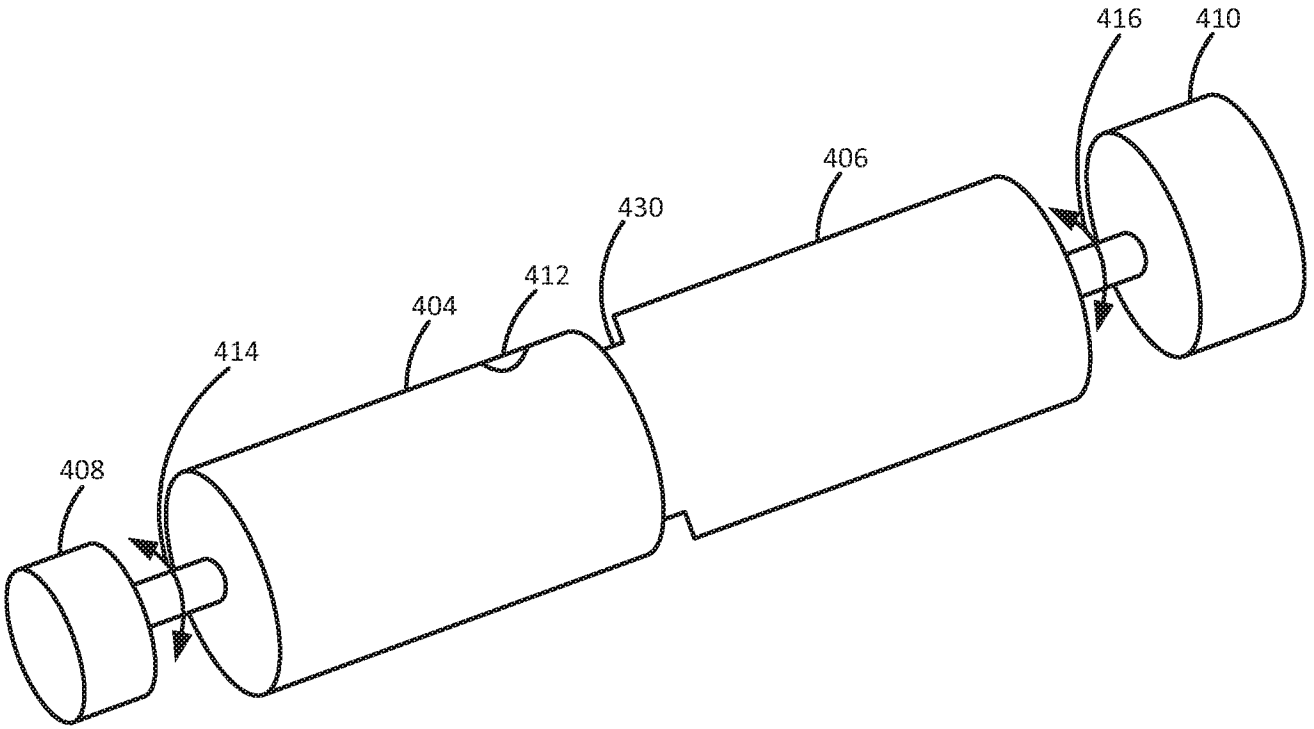
FIG. 4 is an illustration of a second example of a co-axial split drive roller of the present disclosure.

FIG. 4 illustrates a second example of a co-axial split drive roller 402 (also referred to as a roller 402) of the present disclosure. In one example, the roller 402 may include a first roller 404 and a second roller 406. The first roller 404 may be driven by a first motor 408 that drives the first roller 404 along a rotational direction shown by an arrow 414. The second roller 406 may be driven by a second motor 410 that drives the second roller 406 along a rotational direction shown by an arrow 416.

As noted above, the first motor 408 and the second motor 410 may drive the first roller 404 and the second roller 406 in the same direction or in different, opposite directions. The first motor 408 and the second motor 410 may drive the first roller 404 and the second roller 406, respectively, at the same rotational speed or at different rotational speeds. Thus, the first roller 404 and the second roller 406 may be controlled at different operational speeds or directions for a particular application.

In one example, the second roller 406 may be coupled to the first roller 404 via nested bearings inside of the first roller 404, as shown in detail in FIG. 5, and discussed below. A central portion 430 of the second roller 406 with the nested bearings may be inserted into a cylindrical opening of the first roller 404. In one example, the roller 402 may include a port 412. The port may be a grease port to provide lubrication for the nested bearings.

In one example, the first roller 404 and the second roller 406 may have a textured coating. The textured coating may provide a better grip with the print media 116 while rotating to transport the print media 116.

Figure 5:
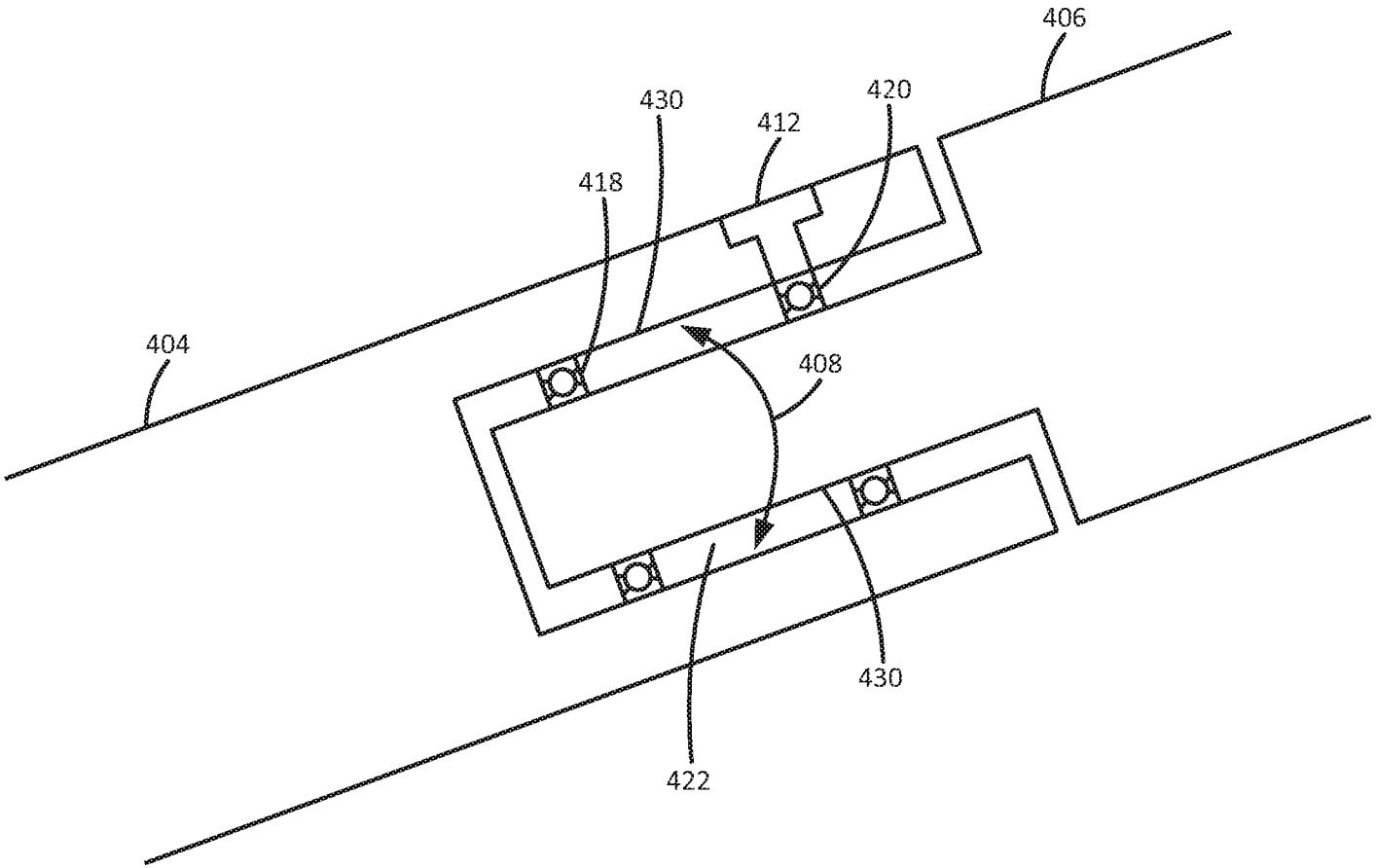
FIG. 5 is cross-sectional view of the second example of the co-axial split drive roller of the present disclosure.

FIG. 5 illustrates a cross-sectional view of the co-axial split drive roller 402 illustrated in FIG. 4. In one example, the roller 402 may include a center portion 430. The center portion 430 may be an extended portion of the second roller 406 that may be inserted into a cylindrical opening 422 of the first roller 404. The cylindrical opening 422 may have a similar shape as the center portion 430 of the second roller 406

In one example, the center portion 430 may include a nested bearing. The nested bearings may include a first bearing 418 and a second bearing 420. The first bearing 418 and the second bearing 420 may have a ring shape. The center portion 430 may fit through the first bearing 418 and the second bearing 420. The first bearing 418 and the second bearing 420 may be inserted into the cylindrical opening 422 with the center portion 430. The first bearing 418 and the second bearing 420 may allow the second roller 406 to rotate around a rotational direction inside of the cylindrical opening 422 as shown by an arrow 408.

In one example, the design of the nested bearing using the center portion 430 may help minimize a distance between the print media 116. In addition, the nested bearing of the roller 402 may eliminate the use of external connection hardware that may add costs to manufacture the roller 402 and use more space between the first roller 404 and the second roller 406.

In one example, the port 412 may be a recessed port as shown in FIG. 5. The port 412 may allow lubricant to be injected into the center portion 430 to lubricate the first bearing 418 and the second bearing 420.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A printer module, comprising:

a co-axial split drive roller, wherein the co-axial split driver roller comprises a first roller comprising a cylindrical opening, a second roller comprising a center portion, wherein the center portion is inserted into the cylindrical opening of the first roller, and a nested bearing comprising a first bearing and a second bearing around the center portion of the second roller and located inside of the cylindrical opening such that the first roller and the second roller rotate independently;

a first motor coupled to the first roller;

a second motor coupled to the second roller; and a print bar over the co-axial split drive roller to dispense print material on print media on the first roller and the second roller.

2. The printer module of claim 1, wherein the co-axial split drive roller comprises a plurality of co-axial split drive rollers.

3. The printer module of claim 2, wherein a first co-axial split drive roller is located before the print bar and a second co-axial split driver roller is located after the print bar.

4. The printer module of claim 1, wherein a first side of a print media is moved by the first roller and a second side of the print media is moved by the second roller.

5. The printer module of claim 1, wherein the first motor rotates the first roller at a rotational speed that is different form a rotational speed of the second roller rotated by the second motor.

6. A co-axial split drive roller, comprising:

a first roller comprising a cylindrical opening; and a second roller comprising a center portion, wherein the center portion is inserted into the cylindrical opening of the first roller; and a nested bearing comprising a first bearing and a second bearing around the center portion of the second roller and located inside of the cylindrical opening such that the first roller and the second roller rotate independently.

7. The co-axial split drive roller of claim 6, further comprising:

a first motor coupled to the first roller to drive the first roller; and a second motor coupled to the second roller to drive the second roller.

8. A co-axial split drive roller of claim 7, wherein the first roller is driven at a different rotational speed than the second roller.

9. The co-axial split drive roller of claim 6, further comprising:

a recessed port to allow for lubrication of the nested bearings.

* * * * *